US005984145A

United States Patent [19]

McAllister

[11] Patent Number: 5,984,145

[45] Date of Patent: Nov. 16, 1999

[54] BODY MOUNTED WATER DISPENSING SYSTEM

[76] Inventor: Rosie J. McAllister, 5336 Orchard St., Weirton, W. Va. 26062

[21] Appl. No.: 09/116,867

[22] Filed: Jul. 16, 1998

[51] Int. Cl.[6] ..... B67D 5/64; A45F 5/00; A42B 1/24

[52] U.S. Cl. ..... 222/175; 224/148.2; 224/181; 381/370

[58] Field of Search ..... 222/175, 129, 222/145.1; 224/148.2, 181; 381/370, 374, 375

[56] References Cited

U.S. PATENT DOCUMENTS

| | | | |
|---|---|---|---|
| 4,681,244 | 7/1987 | Geddie | 222/144.5 |
| 5,104,016 | 4/1992 | Runkel | 224/148 |
| 5,370,278 | 12/1994 | Raynie | 222/175 |
| 5,571,260 | 11/1996 | Krug | 222/175 |
| 5,755,368 | 5/1998 | Bekkadahl | 224/414 |

*Primary Examiner*—Andres Kashnikow
*Assistant Examiner*—Keats Quinalty

[57] ABSTRACT

A new body mounted water dispensing system for providing a convenient method of drinking liquids while exercising. The inventive device includes a water container having a clip disposed thereon. The clip is adapted for coupling the water container to a belt. The water container has a cap removably coupled with an opening extending into a hollow interior. Opposed side walls of the water container each have sealable openings therein with end caps removably coupled therewith. A pump is provided and is disposed within a housing. The housing has a clip disposed on a rear surface thereof. The clip is adapted for coupling the pump to a belt. The pump has a short inlet hose and a long outlet hose each extending outwardly of opposed sides of the housing. The inlet hose extends inwardly of one of the sealable openings of the water container in fluid communication with the hollow interior of the water container. A pliable drinking tube is coupled with a free end of the long outlet hose of the pump.

4 Claims, 2 Drawing Sheets

BODY MOUNTED WATER DISPENSING SYSTEM

BACKGROUND OF THE INVENTION

1. Field of the Invention

The present invention relates to water supply apparatuses and more particularly pertains to a new body mounted water dispensing system for providing a convenient method of drinking liquids while exercising.

2. Description of the Prior Art

The use of water supply apparatuses is known in the prior art. More specifically, water supply apparatuses heretofore devised and utilized are known to consist basically of familiar, expected and obvious structural configurations, notwithstanding the myriad of designs encompassed by the crowded prior art which have been developed for the fulfillment of countless objectives and requirements.

Known prior art water supply apparatuses include U.S. Pat. No. 5,215,231 to Paczonay; U.S. Pat. No. 5,326,124 to Allemang; U.S. Pat. No. Des. 345,134 to Meaker; U.S. Pat. No. 4,815,635 to Porter; U.S. Pat. No. 4,801,088 to Baker; and U.S. Pat. No. 5,370,278 to Raynie.

While these devices fulfill their respective, particular objectives and requirements, the aforementioned patents do not disclose a new body mounted water dispensing system. The inventive device includes a water container having a clip disposed thereon. The clip is adapted for coupling the water container to a belt. The water container has a cap removably coupled with an opening extending into a hollow interior. Opposed side walls of the water container each have sealable openings therein with end caps removably coupled therewith. A pump is provided and is disposed within a housing. The housing has a clip disposed on a rear surface thereof. The clip is adapted for coupling the pump to a belt. The pump has a short inlet hose and a long outlet hose each extending outwardly of opposed sides of the housing. The inlet hose extends inwardly of one of the sealable openings of the water container in fluid communication with the hollow interior of the water container. A pliable drinking tube is coupled with a free end of the long outlet hose of the pump.

In these respects, the body mounted water dispensing system according to the present invention substantially departs from the conventional concepts and designs of the prior art, and in so doing provides an apparatus primarily developed for the purpose of providing a convenient method of drinking liquids while exercising.

SUMMARY OF THE INVENTION

In view of the foregoing disadvantages inherent in the known types of water supply apparatuses now present in the prior art, the present invention provides a new body mounted water dispensing system construction wherein the same can be utilized for providing a convenient method of drinking liquids while exercising.

The general purpose of the present invention, which will be described subsequently in greater detail, is to provide a new body mounted water dispensing system apparatus and method which has many of the advantages of the water supply apparatuses mentioned heretofore and many novel features that result in a new body mounted water dispensing system which is not anticipated, rendered obvious, suggested, or even implied by any of the prior art water supply apparatuses, either alone or in any combination thereof.

To attain this, the present invention generally comprises a belt that is adapted for adjustable positioning around a waist of a user. A water container is provided having a generally rectangular configuration. The water container has a front wall, a rear wall, a top wall, a bottom wall, opposed side walls and a hollow interior. The rear wall has a clip disposed thereon. The clip couples the water container to the belt. The top wall has cap removably coupled with an opening extending into the hollow interior. The opposed side walls each have sealable openings therein with end caps removably coupled therewith. A pump is provided. The pump is disposed within a housing. The housing has a clip disposed on a rear surface thereof. The clip couples the pump to the belt. The pump has a short inlet hose and a long outlet hose each extending outwardly of opposed sides of the housing. The inlet hose extends inwardly of one of the sealable openings of the water container in fluid communication with the hollow interior of the water container. The pump has a power switch disposed in a front wall of the housing. A pliable drinking tube is coupled with a free end of the long outlet hose of the pump. An adjustable headset is provided comprising a U-shaped band coupling with opposed ear pieces. One of the ear pieces couples with the outlet hose of the pump whereby the drinking tube is positioned adjacent to a user's mouth when the headset is positioned on the user's head.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new body mounted water dispensing system apparatus and method which has many of the advantages of the water supply apparatuses mentioned heretofore and many novel features that result in a new body mounted water dispensing system which is not anticipated, rendered obvious, suggested, or even implied by any of the prior art water supply apparatuses, either alone or in any combination thereof.

It is another object of the present invention to provide a new body mounted water dispensing system which may be easily and efficiently manufactured and marketed.

It is a further object of the present invention to provide a new body mounted water dispensing system which is of a durable and reliable construction.

An even further object of the present invention is to provide a new body mounted water dispensing system which is susceptible of a low cost of manufacture with regard to both materials and labor, and which accordingly is then susceptible of low prices of sale to the consuming public, thereby making such body mounted water dispensing system economically available to the buying public.

Still yet another object of the present invention is to provide a new body mounted water dispensing system which provides in the apparatuses and methods of the prior art some of the advantages thereof, while simultaneously overcoming some of the disadvantages normally associated therewith.

Still another object of the present invention is to provide a new body mounted water dispensing system for providing a convenient method of drinking liquids while exercising.

Yet another object of the present invention is to provide a new body mounted water dispensing system which includes a water container having a clip disposed thereon. The clip is adapted for coupling the water container to a belt. The water container has a cap removably coupled with an opening extending into a hollow interior. Opposed side walls of the water container each have sealable openings therein with end caps removably coupled therewith. A pump is provided and is disposed within a housing. The housing has a clip disposed on a rear surface thereof. The clip is adapted for coupling the pump to a belt. The pump has a short inlet hose and a long outlet hose each extending outwardly of opposed sides of the housing. The inlet hose extends inwardly of one of the sealable openings of the water container in fluid communication with the hollow interior of the water container. A pliable drinking tube is coupled with a free end of the long outlet hose of the pump.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
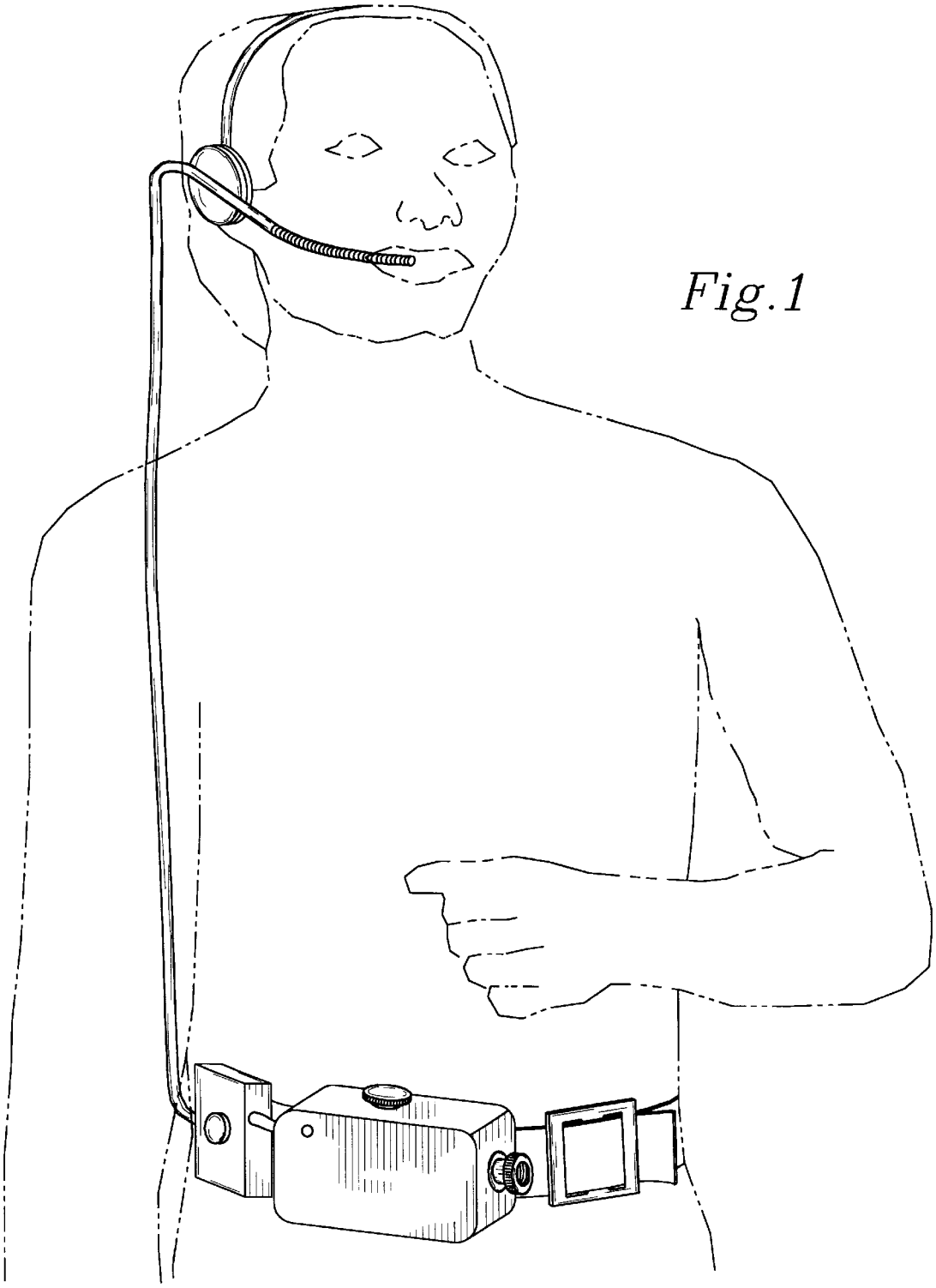
FIG. 1 is a front view of a new body mounted water dispensing system according to the present invention illustrated in use.
Figure 2:
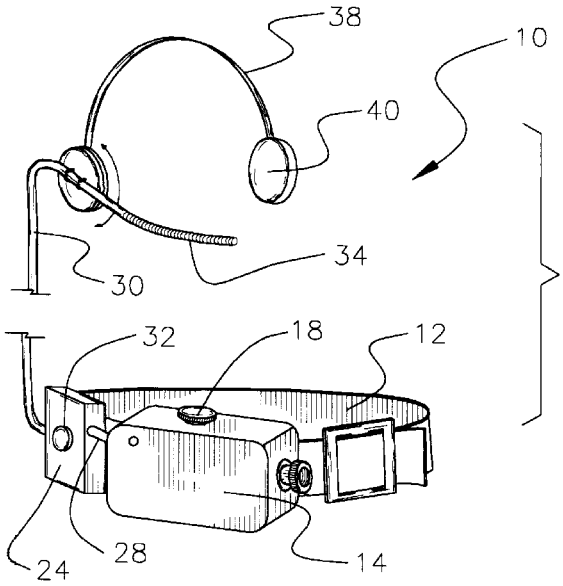
FIG. 2 is a perspective view of the present invention.
Figure 3:
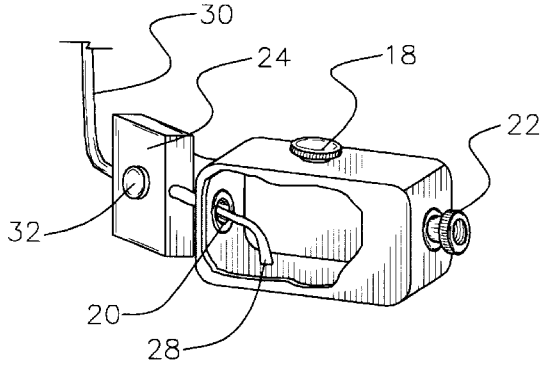
FIG. 3 is a perspective view of the pump and the container of the present invention.
Figure 4:
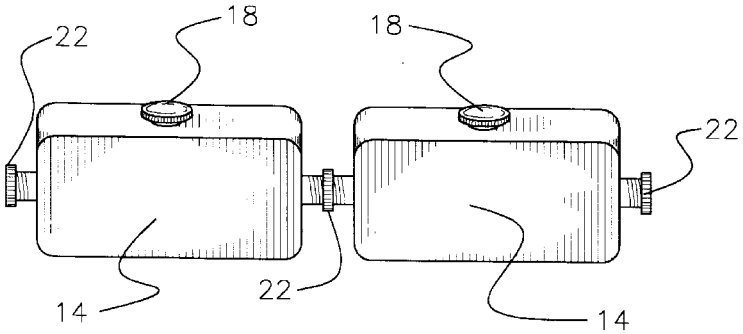
FIG. 4 is a front view of an alternate embodiment of the present invention.
Figure 5:
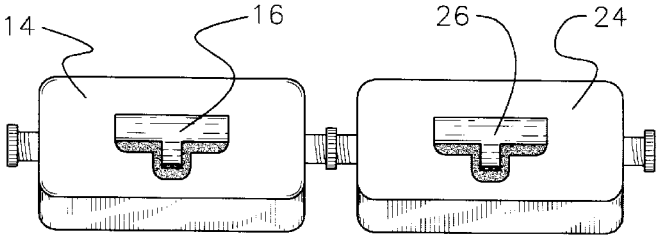
FIG. 5 is a rear view of the pump and the container of the present invention.

With reference now to the drawings, and in particular to FIGS. 1 through 5 thereof, a new body mounted water dispensing system embodying the principles and concepts of the present invention and generally designated by the reference numeral 10 will be described.

As best illustrated in FIGS. 1 through 5, the body mounted water dispensing system 10 comprises a belt 12 that is adapted for adjustable positioning around a waist of a user. The belt 12 can be adjusted to fit users of all sizes.

A water container 14 is provided having a generally rectangular configuration. The water container 14 has a front wall, a rear wall, a top wall, a bottom wall, opposed side walls and a hollow interior. The rear wall has a clip 16 disposed thereon. The clip 16 couples the water container 14 to the belt 12. The top wall has a cap 18 removably coupled with an opening extending into the hollow interior. The opposed side walls each have sealable openings 20 therein with end caps 22 removably coupled therewith. When more than one water container 14 are to be used, the end caps 22 of the opposed side walls can be coupled together so as to provide twice the amount of liquid.

A pump is provided. The pump is disposed within a housing 24. The housing 24 has a clip 26 disposed on a rear surface thereof. The clip 26 couples the pump to the belt 12. The pump has a short inlet hose 28 and a long outlet hose 30 each extending outwardly of opposed sides of the housing 24. The inlet hose 28 extends inwardly of one of the sealable openings 20 of the water container 14 in fluid communication with the hollow interior of the water container 14. The pump has a power switch 32 disposed in a front wall of the housing 24. The pump is preferably powered by a battery positioned within the housing 24.

A pliable drinking tube 34 is coupled with a free end of the long outlet hose 30 of the pump. The drinking tube 34 can be maneuvered to adapt to a particular user.

An adjustable headset 36 is provided comprising a U-shaped band 38 coupling with opposed ear pieces 40. One of the ear pieces 40 couples with the outlet hose 30 of the pump whereby the drinking tube 34 is positioned adjacent to a user's mouth when the headset 36 is positioned on the user's head. Alternately, the outlet hose 30 and the drinking tube 34 could be coupled with an existing headset from a portable radio or the like.

In use, the present invention is a product that would allow an exercise enthusiast to take a drink without having to stop an activity. To use the system, the user would fill the water container 14 with water or another preferred beverage, clip the water container 14 to the belt 12, connect the inlet hose 28 for the pump to the side of the water container 14 and clip the pump to the belt 12, put the headset 36 on, and position the drinking tube 34 in front of their mouth. When the user gets thirsty, they would push the power switch 32 on the pump, and it would pump liquid from the water container 14 up through the outlet hose 30 and out the drinking tube 34 and into the mouth. The power switch 32 would be pushed a second time to turn the pump off and stop the flow of liquid.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new body mounted water dispensing system for providing a convenient method of drinking liquids while exercising comprising, in combination:

a belt adapted for adjustable positioning around a waist of a user;

a water container having a generally rectangular configuration, the water container having a front wall, a rear wall, a top wall, a bottom wall, opposed side walls and a hollow interior, the rear wall having a clip disposed thereon, the clip coupling the water container to the belt, the top wall having a cap removably coupled with an opening extending into the hollow interior, the opposed side walls each having sealable openings therein with end caps removably coupled therewith;

a pump disposed within a housing, the housing having a clip disposed on a rear surface thereof, the clip coupling the pump to the belt, the pump having a short inlet hose and a long outlet hose each extending outwardly of opposed sides of the housing, the inlet hose extending inwardly of one of the sealable openings of the water container in fluid communication with the hollow interior of the water container, the pump having a power switch disposed in a front wall of the housing;

a pliable drinking tube coupled with a free end of the long outlet hose of the pump; and an adjustable headset comprising a U-shaped band coupling with opposed ear pieces, one of the ear pieces coupling with the outlet hose of the pump whereby the drinking tube is positioned adjacent to a user's mouth when the headset is positioned on the user's head.

2. A new body mounted water dispensing system for providing a convenient method of drinking liquids while exercising comprising, in combination:

at least one water container having a clip disposed thereon, the clip adapted for coupling the water container to a belt, the water container having a cap removably coupled with an opening extending into a hollow interior, opposed side walls of the water container each having sealable openings therein with end caps removably coupled therewith;

a pump disposed within a housing, the housing having a clip disposed on a rear surface thereof, the clip adapted for coupling the pump to a belt, the pump having a short inlet hose and a long outlet hose each extending outwardly of opposed sides of the housing, the inlet hose extending inwardly of one of the sealable openings of the water container in fluid communication with the hollow interior of the water container; and a pliable drinking tube coupled with a free end of the long outlet hose of the pump.

3. The body mounted water dispensing system as set forth in claim 2 and further including an adjustable headset comprised of a U-shaped band coupling with opposed ear pieces, one of the ear pieces coupling with the outlet hose of the pump whereby the drinking tube is positioned adjacent to a user's mouth when the headset is positioned on the user's head.

4. The body mounted water dispensing system as set forth in claim 2 wherein the pump has a power switch disposed in a front wall of the housing.

* * * * *